US006324293B1

(12) United States Patent
Muis

(10) Patent No.: US 6,324,293 B1
(45) Date of Patent: Nov. 27, 2001

(54) MICROPHONE SANITIZER AND HOLSTER

(76) Inventor: Robert Chris Muis, 2442 S. Ridge Ave., Bullhead City, AZ (US) 86429

( * ) Notice: Subject to any disclaimer, the term of this patent is extended or adjusted under 35 U.S.C. 154(b) by 0 days.

(21) Appl. No.: 09/405,078

(22) Filed: Sep. 27, 1999

(51) Int. Cl.[7] ..... H04R 25/00

(52) U.S. Cl. ..... 381/361; 381/366; 379/439; 379/452

(58) Field of Search ..... 381/355, 361, 381/322, 363, 366; 221/45, 48, 50, 63; 206/494; 379/439, 452

(56) References Cited

U.S. PATENT DOCUMENTS

| | | | | |
|---|---|---|---|---|
| D. 384,077 | | 9/1997 | Frasse . | |
| 4,146,191 | | 3/1979 | Cavanaugh . | |
| 4,423,293 | | 12/1983 | Murayama et al. . | |
| 4,751,731 | * | 6/1988 | O'Connor | 379/439 |
| 4,760,984 | | 8/1988 | Hennessey . | |
| 4,811,405 | | 3/1989 | Peiker . | |
| 4,991,220 | * | 2/1991 | Wolf | 381/361 |
| 5,410,608 | | 4/1995 | Lucey . | |
| 5,503,141 | * | 4/1996 | Kettl et al. | 381/361 |
| 5,675,660 | * | 10/1997 | Townsend et al. | 381/361 |
| 5,938,069 | * | 8/1999 | Macchia | 221/48 |

* cited by examiner

*Primary Examiner*—Curtis Kuntz
*Assistant Examiner*—Suhan Ni

(57) ABSTRACT

An all-encompassing atomizing dispenser device for sanitizing and holstering a microphone in which to prevent the spread of harmful bacteria and germs to the general singing and speaking public. The invention consists of a plastic cylinder or tube of appropriate size to holster a handheld microphone, comprising an inverted spray bottle with a standard fine mist spray nozzle, fixed in one basic direction for atomizing said microphone when holstered within the device. The device is covered entirely with fabric, except for an opening at one end in which a microphone may be inserted, and consists of straps for fastening means to any standard television monitor stand. A user can simply insert a microphone, press down on the inverted spray bottle, and atomize the microphone instantaneously.

10 Claims, 5 Drawing Sheets

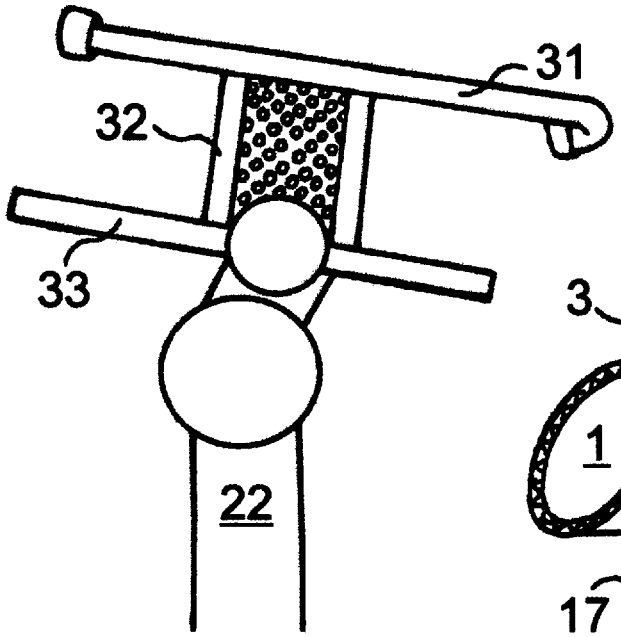
FIG. 8
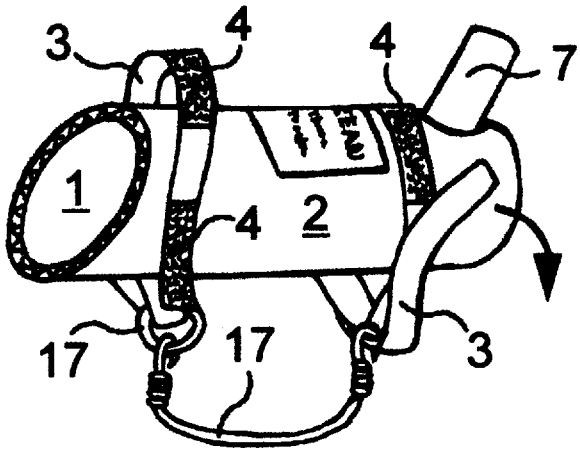
FIG. 9
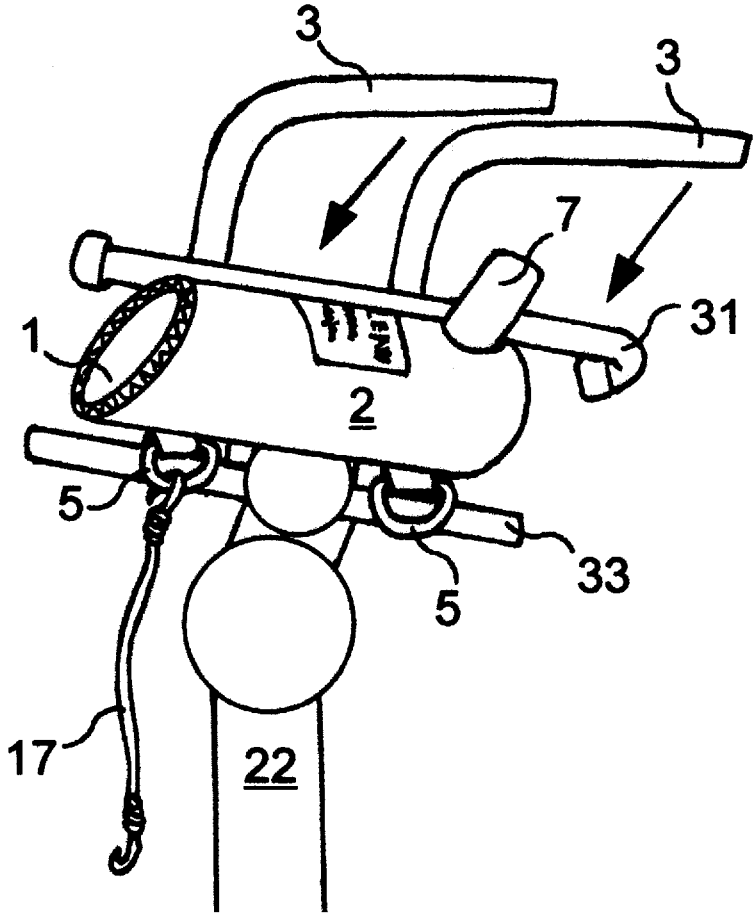

MICROPHONE SANITIZER AND HOLSTER

BACKGROUND OF THE INVENTION

1. Field of the Invention

This invention relates to a device that can be attached to a Karaoke television monitor stand for the purpose of inserting a handheld microphone to disinfect and deodorize the microphone before it is passed to the next user, furthermore, serving as a microphone holder while the instrument in not in use.

2. Description of the Prior Art

As well known, microphone holders usually consist of a clip that the microphone rests in while a person is speaking or singing in order that the individual does not have to hole the instrument. It is further noted that microphone holders also serve as a place in which to rest the instrument while it is not in use, whereas, there is no device that an individual may place a microphone to disinfect and deodorize it while placing it into a holder.

A number of patents disclose such holders which secure the microphone in place but have no means in which to sanitize the instrument before the next individual uses it.

U.S. Pat. No. 4,146,191 discloses a device in which a microphone retriever is detachably mounted on a fixed holding device in order that a driver of a vehicle may devote full attention to guiding the vehicle rather than returning the hand-held microphone of such equipment to its storage position. It is therefore noted that this prior art has no bearing or resemblance to my invention.

U.S. Pat. No. 4,423,293 discloses a microphone holder or casing in order that the microphone is placed perpendicularly to the surface of a concave of a helmet, etc. Again, this type of prior art bears no resemblance to my invention.

U.S. Pat. No. 4,760,984 discloses a quick-disconnect microphone holder assembly having a clip type holder in which the microphone sits in, once again, having no means of holstering and sanitizing a microphone.

U.S. Pat. No. 4,811,405 discloses a microphone holding device in which a microphone can be clipped onto various objects, therefore, having no resemblance to my invention.

U.S. Pat. No. 5,410,608 discloses a microphone including a housing device and aperture therein in order that the device in its entirety may be worn by the individual or clipped onto a device, therefore again, having no resemblance to my invention.

U.S. Pat. No. Des. 284,077 discloses a microphone holding device in which numerous microphones may be placed or inserted into the holes of the device, still bearing no resemblance to my invention.

While it can be thus appreciated that the field of microphone holders were designed to keep the instrument in place, the prior art described does not propose the capability to disinfect a microphone before it is passed to another user.

SUMMARY OF THE INVENTION

In view of the above, it is an object of the invention to provide a device for sanitizing a handheld microphone, therefore, preventing a user from receiving and passing harmful bacteria that can cause numerous illnesses.

A primary object of the present invention is to provide an easy insertible and retrievable holster for a handheld microphone, saving time trying to insert the instrument into a conventional clip holder device.

Another object of the present invention is to provide a device that can be easily attached to any Karaoke television monitor stand or other unit thereof.

A further object of the present invention is to provide a device that is easy to use by simply pressing on the inverted bottle a few times to atomize a handheld microphone.

In broad aspect of the invention, a device for sanitizing and holstering a handheld microphone is provided. A combination handheld microphone sanitizer and holster device is disclosed by the present invention. The combination includes a plastic tube of appropriate size comprising a standard atomizing cylinder shaped bottle containing a solution that eliminates harmful bacteria. The device further includes means for easily attaching the device to any television monitor stand or other appropriate stand.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The invention is illustrated in the accompanying drawings in which:

FIG. 1 is a perspective view of the preferred embodiment of the present invention depicting the device in its entirety accompanied by the instrument it was invented for;

FIG. 8 is a perspective view of the preferred embodiment of the present invention depicting the device in its entirety along with the television monitor stand it is to be attached to thereof;

FIGS. 9, 10, and 11 are perspective views of the preferred embodiment of the present invention depicting the device in its entirety, being strapped in sequential steps onto the television monitor stand it is to be attached to thereof.

DETAILED DESCRIPTION OF THE PREFERRED EMBODIMENT

Figure 1:
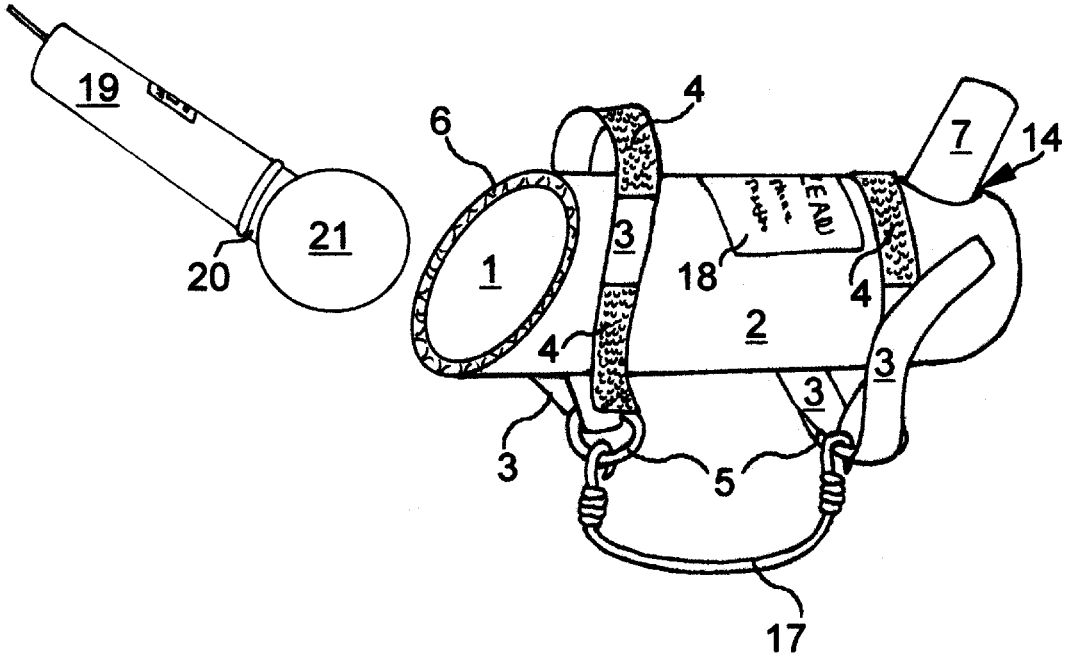
Figure 3:
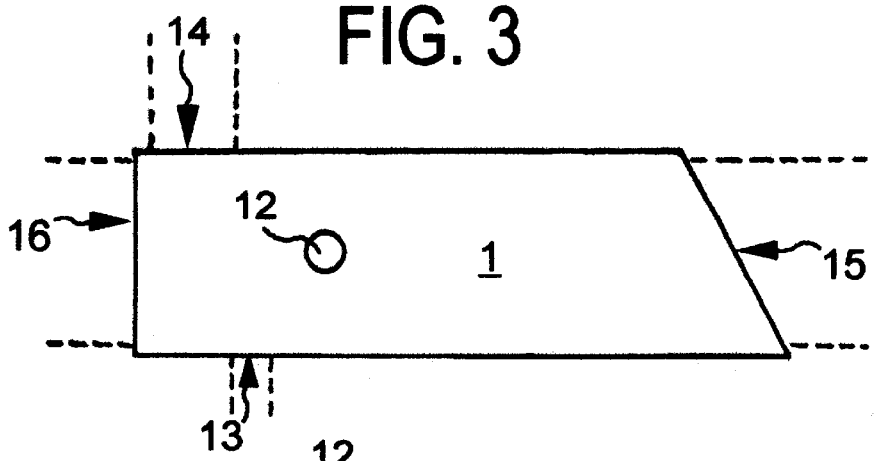
FIG. 3 is a side view thereof, without its material covering.
Figure 4:
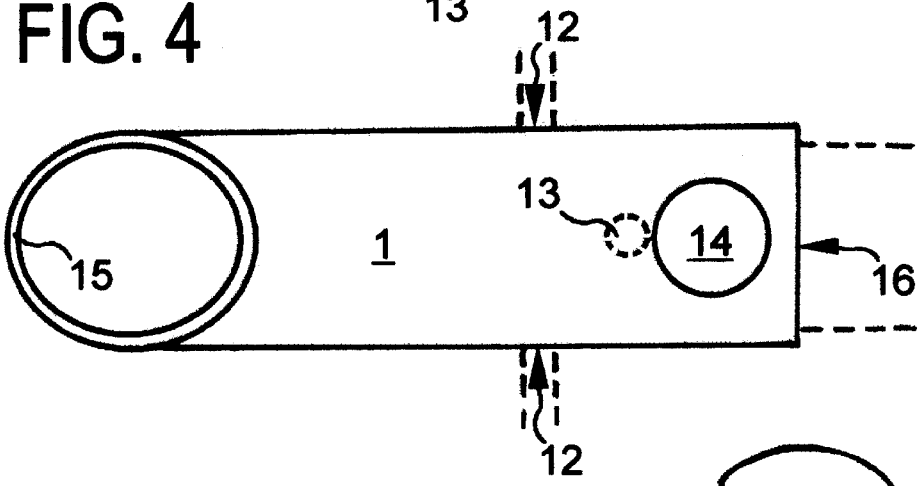
FIG. 4 is a top view thereof, without its material covering.
Figure 5:
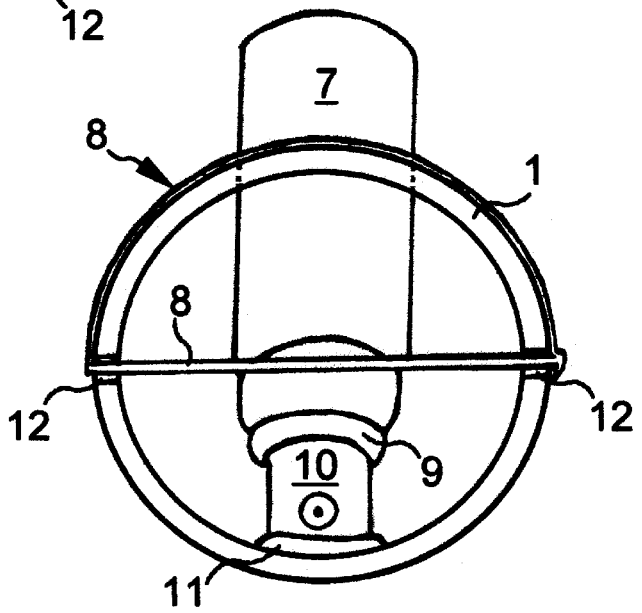
FIG. 5 is a front view thereof, without its material covering.

Referring now to the drawings, in particular to FIGS. 1 through 11, a microphone sanitizer and holster device comprising the following detailed preferred embodiment as illustrated in FIG. 1:

An rigid non-breakable plastic cylinder or tube 1 comprising an angle cut 15 of approximately 30 degrees on one end and a straight cut 16 on the other end as illustrated in FIG. 3. Approximately ¼" from the straight cut 16 end of the cylinder or tube on the top side FIG. 4 is a first circular hole 14 in appropriate size, in which to house an atomizing cylinder shaped bottle 7. At both sides of the cylinder or tube 1 as illustrated in FIGS. 3 and 4, a second circular hole 12 is drilled through in order to house a plastic cable tie 8 which prevents a microphone 19 from slipping into the device too far as illustrated in FIG. 5. A third drilled circular hole 13 located at the bottom side of said cylinder or tube 1 as illustrated in FIG. 4, houses high strength hot melt glue 11 in which a misting nozzle 10 is permanently affixed to.

Figure 2:
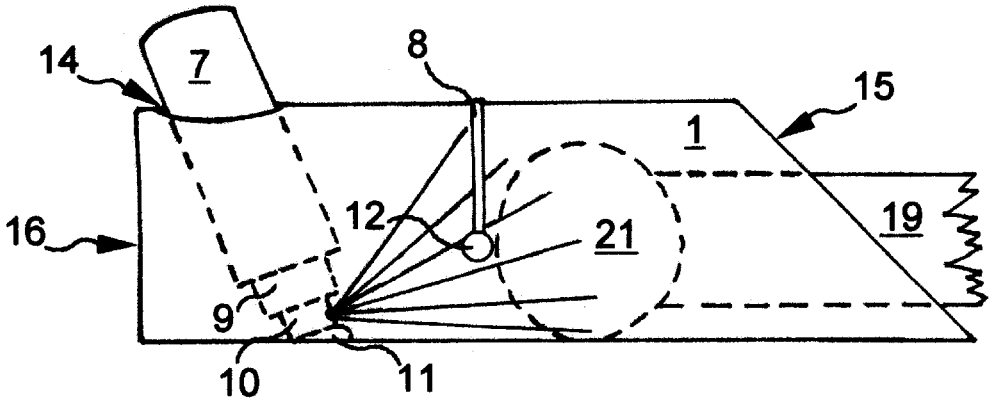
FIG. 2 is a cut-in-half side view thereof, with the invention presumably in use without its material covering.

An atomizing cylinder shaped bottle 7 along with a spraying apparatus 9 is inserted into the cylinder shaped bottle hole 14 in an inverted position into the misting nozzle 10 within the cylinder or tube 1 at an angle, as illustrated in FIG. 2, in order that the fine mist will encompass an entire foam fitted microphone cover 21 for proper sanitation.

A plastic cable tie 8 is inserted through second hole 12 to opposite second hole 12 located at sides of the cylinder or tube 1, then is wrapped around the top half portion of the cylinder or tube 1, in which both ends are connected and locked as illustrated in FIG. 5.

Figure 6:
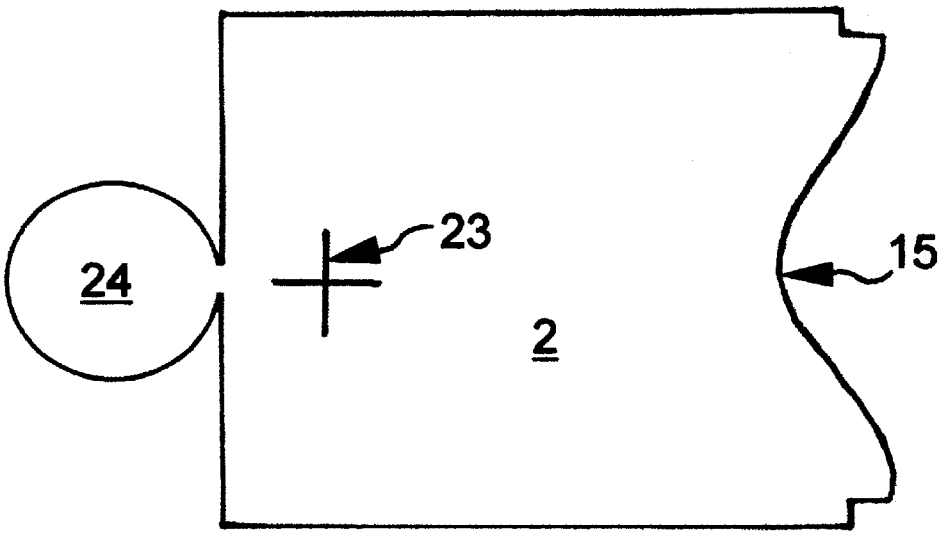
FIG. 6 is a perspective view of the material-covering pattern of the present invention.
Figure 7:
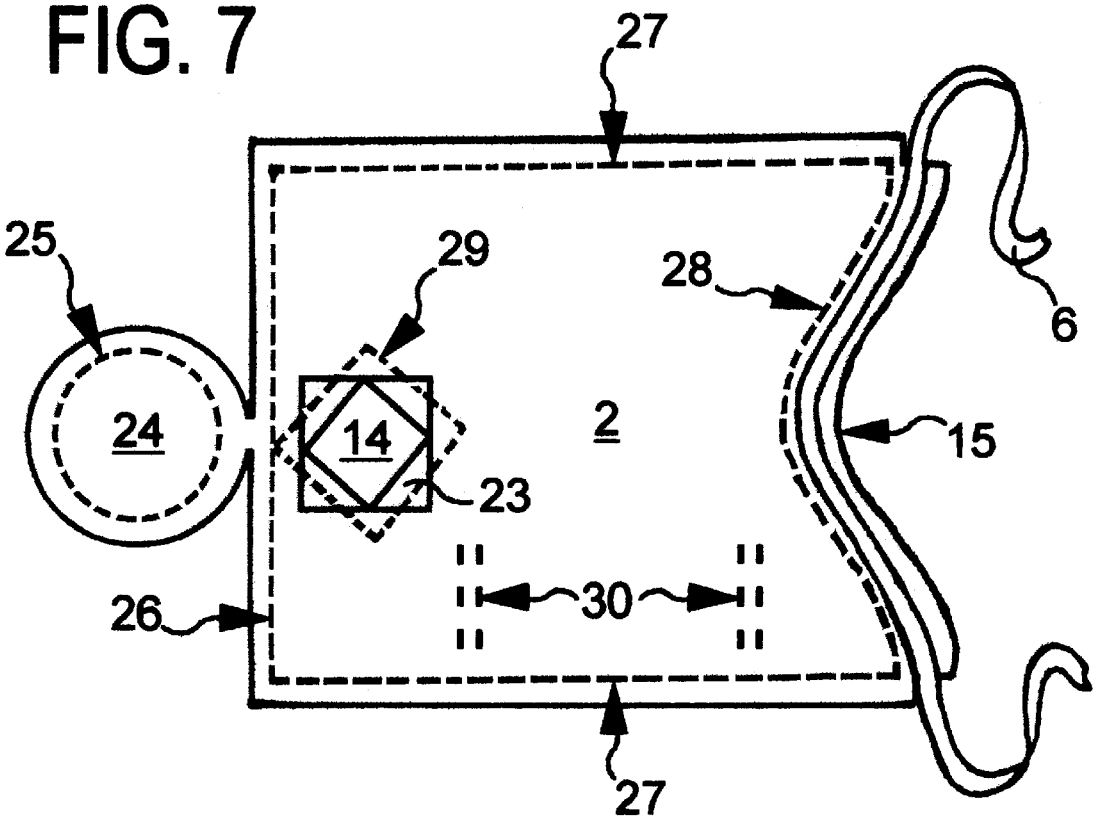
FIG. 7 is a perspective view of the material covering as sewn for the present invention.

An outer material covering 2 of the device consisting of denier or nylon is cut out as illustrated in FIG. 6 comprising a cross cut 23 in which the points of the cut 23 are folded back and sewn down 29 on the wrong side of outer material covering 2, as illustrated in FIG. 7, therefore, forming a diamond shaped opening 14 for snug insertion of the atomizing cylinder shaped bottle 7. The circle cut-out 24 is sewn to the outer material covering 2 at the back seam line 25 and seam line 26, whereas, side seam lines 27 are also sewn together, as illustrated in FIG. 7, forming a circular bag for a custom fit onto the cylinder or tube 1 as illustrated in FIG. 1. A folded over edge on the angle cut side 15 comprising a front seam 28 on the outer material covering 2 comprises an elastic strap 6, which is later pulled tight and permanently knotted after the completed outer material covering 2 is slipped over the cylinder or tube 1.

Two polypropylene or nylon straps 3 comprising a "D" ring 5 sewn onto one end, whereas, at the other end an approximate sized strip of hook and loop fastening 4 is sewn or adhered thereto as illustrated in FIG. 1. The polypropylene or nylon straps 3 are sewn or adhered 30 to one side only of the outer material covering 2, as illustrated in FIG. 7, depicting the side that the device will be strapped onto, therefore having a left-sided device and a right-sided device.

Figure 10:
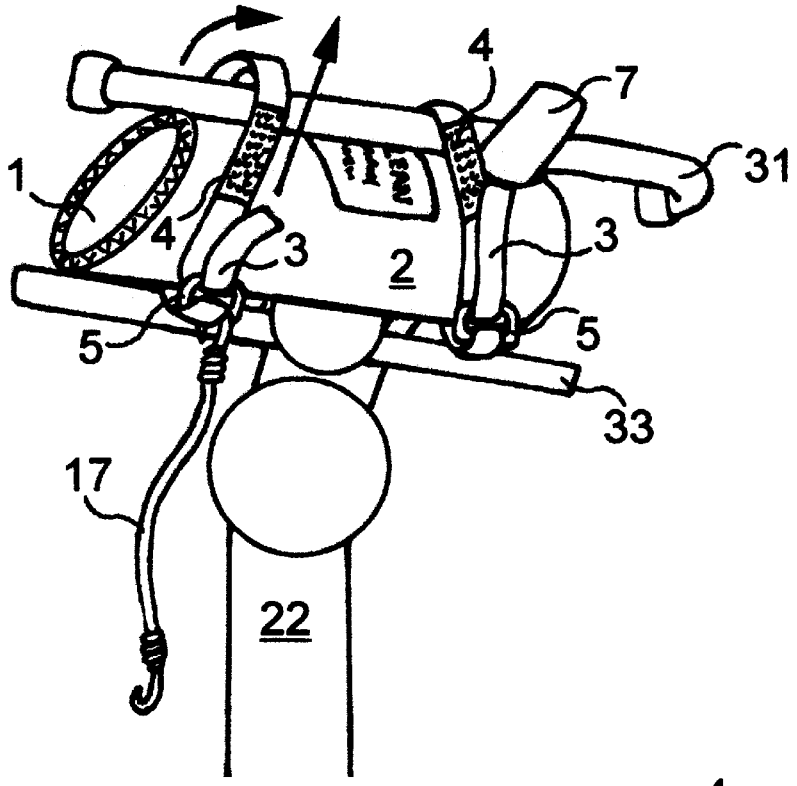
Figure 11:
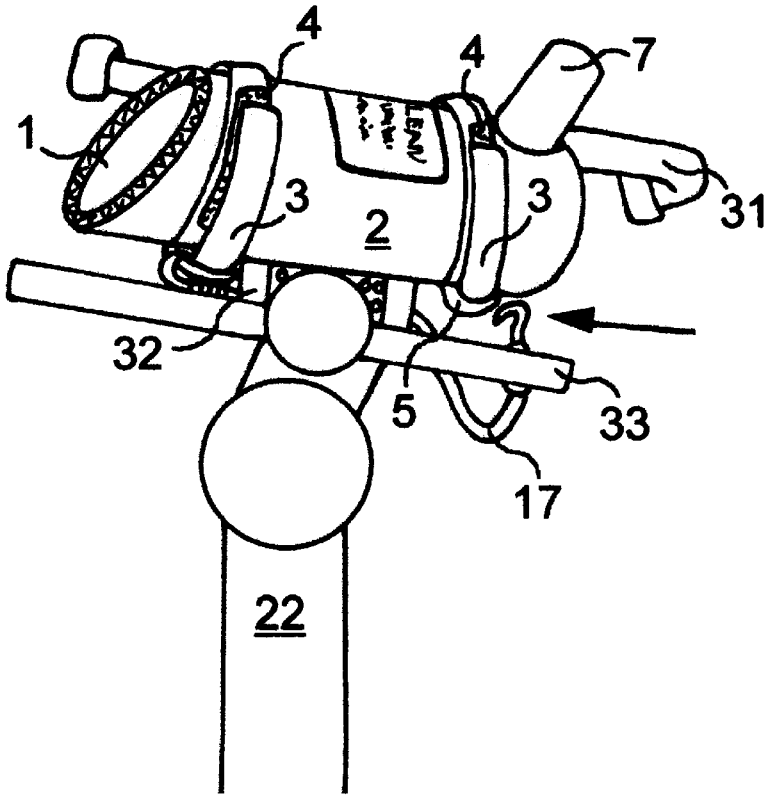

An elastic cord 17 with metal or plastic hooks, one being hooked and permanently crimped to the "D" ring 5 located at the front of the cylinder or tube 1 neighboring the angle cut 15. The other end of the elastic cord 17 is hooked onto the opposite "D" ring 5 located near the inverted atomizing cylinder shaped bottle 7 on the cylinder or tube 1, allowing the user to unhook and re-hook the elastic cord 17 in order to strap the device properly onto a television monitor stand 22, as illustrated in FIGS. 10 and 11.

A handheld microphone 19 will be fitted with a color identification band 20 comprising a polypropylene or nylon strap with elastic in the appropriate color to match the outer material covering 2 of the device, whereas, there may be another device of a different color strapped onto the opposite side of the same television monitor stand 22.

Referring now to the drawings, specifically to FIGS. 8 through 11, a microphone sanitizer and holster being strapped or attached to a television monitor stand 22 as follows:

As illustrated in FIG. 8, the hook and loop fastening strips 4 on the polypropylene or nylon straps 3 are pulled open freeing the polypropylene or nylon straps 3 from the device.

As illustrated in FIG. 9, the device is placed against the side of a television monitor stand 22. The polypropylene or nylon straps 3 are placed behind the horizontal top bar 31 of the television monitor stand 22 and are ready to be brought forward over the top and down, and placed through the "D" rings 5. The elastic cord 17 has been unhooked and is ready for placement.

As illustrated in FIG. 10, the polypropylene or nylon straps 3, whereas, inserted into the "D" rings 5, are pulled tight and are overlapped adhering the hook and loop fastening 4, attaching the device firmly to the horizontal top bar 31 of the television monitor stand 22.

As illustrated in FIG. 11, the elastic cord 17 is now brought around the back center support 32 of the television monitor stand 22 or under the bottom horizontal bar 33 of the television monitor stand 22, then, is returned by hooking it back into the "D" ring 5 of the device, providing a firm grip onto the television monitor stand 22.

I claim:

1. A microphone sanitizer and holster device comprising:

a) a cylinder or tube fabricated of a rigid non-breakable plastic material bearing an angle cut of approximately 30 degrees on one end and a straight cut on opposite end;

b) a first hole on top side of the device in appropriate size to house a cylinder shaped atomizing bottle;

c) a second hole on each side of the device in which a plastic cable tie is inserted, preventing a handheld microphone from slipping into the device too far;

d) a third hole on bottom side of the device for the purpose of containing an adhesive to affix a misting nozzle in place permanently;

e) a water repellent fabric covering the device in its entirety leaving said angle cut opening exposed;

f) an appropriate sized opening on said fabric, matching with said first hole on cylinder or tube, wherein, a cylinder shaped atomizing bottle may be inserted;

g) an elastic band or draw string inserted into a hem of said fabric on said open angle cut end, that when pulled tight, secures said fabric firmly onto said cylinder or tube;

h) polypropylene or nylon straps comprising hook and loop fastening means permanently attached on once side of said fabric in order to secure the device into a proper position on a television monitor stand or other appropriate stand;

i) "D" rings sewn onto each said polypropylene or nylon strap, in which said straps are pulled through and adhered onto themselves by means of hook and loop fastening;

j) an elastic cord with hooks to secure the device on a television monitor stand by hooking said elastic cord onto said "D" rings;

k) a misting nozzle from a cylinder shaped atomizing bottle, permanently affixed in a proper position at said third hole on said inside of cylinder or tube;

l) a cylinder shaped atomizing bottle with spraying apparatus inserted at an angle into said first hold of said cylinder or tube, whereas, a user would push down on said inverted bottle top to engage a fine mist over a handheld microphone;

m) a disinfectant solution capable of killing bacteria when dispersed onto said handheld microphone;

n) further comprising a microphone identification band with elastic properties and can be easily slipped onto any handheld microphone.

2. The microphone sanitizer and holster device of claim 1 wherein said cylinder or tube bears a straight cut on both ends.

3. The microphone sanitizer and holster device of claim 1 wherein said plastic cable tie can be replaced with a rod or nut and bolt, preventing a handheld microphone from slipping into the device too far.

4. The microphone sanitizer and holster device of claim 1 wherein said polypropylene or nylon straps are replaced by elastic cords with hooks.

5. The microphone sanitizer and holster device of claim 1 wherein said polypropylene or nylon straps are replaced by clamps.

6. The microphone sanitizer and holster device of claim 1 wherein said hook and loop fastening means is replaced by an adjustable closure device such as a buckle.

7. A microphone sanitizer and holster device comprising:

a) a cylinder or tube fabricated of a rigid non-breakable plastic material;

b) a first hole on bottom side of said cylinder or tube in appropriate size to house a cylinder shaped atomizing bottle;

c) a second hole on each side of said cylinder or tube in which an "L" shaped rod is inserted all the way through, serving as an elbow and brace for said cylinder to swivel up and down on;

d) a chassis in the shape of an "L" slightly shorter than said cylinder or tube, fabricated of rigid non-breakable plastic material in which said "L" shaped rod is affixed against both wall sides of said chassis, therefore, providing a shelf for said cylinder or tube to rest upon and for placement of the device onto any flat surface;

e) a cylinder shaped atomizing bottle comprising spraying apparatus and misting nozzle inserted into said first hole, right-side-up, bottom of said bottle resting upon said chassis, holding said cylinder or tube at a level, but slightly angled up position, whereas, when a user inserts a microphone into said cylinder or tube and presses or taps said microphone down, said spraying apparatus is engaged releasing atomizing mist onto head of said microphone;

f) hook and loop fastening means affixed to said misting nozzle and inside of said cylinder or tube holding and positioning said misting nozzle in one direction;

g) two hooks or snap rings attached to top side of said chassis in appropriate size and spacing to fit onto any television monitor stand or any other appropriate stand;

h) an elastic cord with hooks attached to each corner of bottom side of said chassis to secure the device onto any television monitor stand or any other appropriate stand;

i) a disinfecting and deodorizing solution capable of eliminating bacteria when dispersed onto said handheld microphone.

8. The microphone sanitizer and holster device of claim 7 wherein said "L" shaped chassis top side is looped over or bent over in a configuration to hook onto any television monitor stand or any other appropriate stand.

9. The microphone sanitizer and holster device of claim 7 wherein said chassis is in the shape of a "U", but flat sided on bottom, whereas, a straight rod or bolt is inserted into said second holes in place of said elbow.

10. The microphone sanitizer and holster device of claim 9 wherein said chassis is in the shape of a "U", further comprising a loop or bent over edge on each top side of said chassis in a configuration to hook onto either side of any television monitor stand or any other appropriate stand.

* * * * *